US012453366B2

(12) United States Patent
Kim et al.

(10) Patent No.: US 12,453,366 B2
(45) Date of Patent: Oct. 28, 2025

(54) ULTRA-LOW NICOTINE SMOKING ARTICLE

(71) Applicant: KT&G CORPORATION, Daejeon (KR)

(72) Inventors: Han Saem Kim, Daejeon (KR); Jae Woo Park, Daejeon (KR); Yeon Seok Jung, Daejeon (KR); Young Jin Choi, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 0 days.

(21) Appl. No.: 18/354,290

(22) Filed: Jul. 18, 2023

(65) Prior Publication Data

US 2024/0206524 A1 Jun. 27, 2024

Related U.S. Application Data

(63) Continuation of application No. PCT/KR2023/001225, filed on Jan. 27, 2023.

(30) Foreign Application Priority Data

Dec. 23, 2022 (KR) ..... 10-2022-0183152

(51) Int. Cl.
*A24B 15/24* (2006.01)
*A24D 3/04* (2006.01)

(52) U.S. Cl.
CPC ..... *A24B 15/243* (2013.01); *A24D 3/043* (2013.01)

(58) Field of Classification Search
CPC ..... A24D 1/045; A24D 3/043; A24B 15/243
See application file for complete search history.

(56) References Cited

U.S. PATENT DOCUMENTS 4,714,082 A * 12/1987 Banerjee ..... A24D 1/18 131/365
2008/0173320 A1* 7/2008 Dunlap ..... A24D 1/02 131/365

(Continued)

FOREIGN PATENT DOCUMENTS

KR 1998-0073733 A 11/1998
KR 10-0202456 B1 6/1999

(Continued)

OTHER PUBLICATIONS

Christian Agyare, et al., "Anti-Inflammatory and Analgesic Activities of African Medicinal Plants," 2013, Medicinal Plant Research in Africa, pp. 725-752, retrieved from Science Direct (https://www.sciencedirect.com/science/article/pii/B9780124059276000199) (Year: 2013).*

(Continued)

*Primary Examiner* — Philip Y Louie
*Assistant Examiner* — Yana B Krinker
(74) *Attorney, Agent, or Firm* — Sughrue Mion, PLLC

(57) ABSTRACT

The present disclosure relates to an ultra-low nicotine smoking article. The smoking article includes a medium part and a filter part, in which the medium part includes a tobacco medium including flue-cured tobacco, dry ice expanded tobacco, and expanded stems, the tobacco medium includes 50% by weight (wt %) to 60 wt % of flue-cured tobacco, 20 wt % to 30 wt % of dry ice expanded tobacco, and 10 wt % to 30 wt % of expanded stems based on the total weight, and the tobacco medium has a nicotine content of 0.01% to 0.05%.

14 Claims, 2 Drawing Sheets

(56) References Cited

U.S. PATENT DOCUMENTS

| | | | | |
|---|---|---|---|---|
| 2014/0190497 | A1 | 7/2014 | Dube et al. | |
| 2014/0261503 | A1* | 9/2014 | Kim | A24D 1/025 131/365 |
| 2016/0316815 | A1* | 11/2016 | Couderc | A24D 3/163 |
| 2019/0274349 | A1 | 9/2019 | Sugyo et al. | |

FOREIGN PATENT DOCUMENTS

| | | | |
|---|---|---|---|
| KR | 10-0844444 | B1 | 7/2008 |
| KR | 10-2013-0045157 | A | 5/2013 |
| KR | 10-2016-0104619 | A | 9/2016 |
| KR | 10-2017-0093210 | A | 8/2017 |
| KR | 10-2022-0157069 | A | 11/2022 |

OTHER PUBLICATIONS

International Search Report issued Sep. 15, 2023 in International Application No. PCT/KR2023/001225.
Korean Office Action dated Mar. 10, 2025 in Application No. 10-2022-0183152.

* cited by examiner

ULTRA-LOW NICOTINE SMOKING ARTICLE

TECHNICAL FIELD

The present disclosure relates to an ultra-low nicotine smoking article.

BACKGROUND ART

In general, tobacco refers to a perennial plant belonging to the Solanaceae of the dicotyledonous plant order, and recently, also collectively refers to a cigarette manufactured for the purpose of smoking in which the leaves of tobacco are wrapped with cigarette paper and a filter portion is formed at one side. There are thousands of kinds of tobacco worldwide, and they have been released in various shapes and forms.

The nicotine content of commercially available smoking articles currently being sold on the market is approximately 5% or less. However, there is a recent trend to lower the nicotine content of smoking articles all over the world.

Conventionally, in order to produce tobacco with low nicotine content, methods such as using leaves of other plants (medicinal herb leaves, etc.) instead of leaf tobacco, immersing leaf tobacco, or using an adsorbent have been used. However, it was difficult to match the preference of smokers accustomed to the tobacco taste of existing leaf tobacco, to sufficiently reduce the nicotine content, and to easily use it due to cumbersome processes.

Accordingly, it is necessary to develop a smoking article whose nicotine content in the leaves is lowered more easily compared to existing commercially available smoking articles.

DISCLOSURE OF THE INVENTION

Technical Goals

In order to solve the above problems, an aspect of the present disclosure is to provide a smoking article that maintains the taste of tobacco while lowering the nicotine content of the tobacco medium by applying ultra-low nicotine leaf tobacco to the smoking article and adjusting the blending ratio of the tobacco medium.

However, technical goals to be achieved are not limited to those described above, and other goals not mentioned above are clearly understood by one of ordinary skill in the art from the following description.

Technical Solutions

According to one embodiment of the present disclosure, there is provided an ultra-low nicotine smoking article including a medium part and a filter part, wherein the medium part contains a tobacco medium including flue-cured tobacco, dry ice expanded tobacco, and expanded stems, the tobacco medium includes 50% by weight (wt %) to 60 wt % of flue-cured tobacco, 20 wt % to 30 wt % of dry ice expanded tobacco, and 10 wt % to 30 wt % of expanded stems based on the total weight, and the tobacco medium has a nicotine content of 0.01% to 0.05%.

According to another embodiment of the present disclosure, there is provided an ultra-low nicotine smoking article including a medium part and a filter part, wherein the medium part contains a tobacco medium including flue-cured tobacco, dry ice expanded tobacco, and expanded stems, the tobacco medium has a nicotine content of 0.01% to 0.05%, and tar and nicotine among smoke components in the mainstream smoke of the smoking article have a content ratio of 80:1 to 400:1.

Effects

When the smoking article according to the present disclosure is used, it is possible to provide an ultra-low nicotine smoking article in which the tobacco medium has a nicotine content of 0.05% or less while maintaining the tobacco taste and combustibility (or thermal conductivity) of the smoking article.

The effects of the present disclosure are not limited to the above effects, and should be understood to include all effects that may be inferred from the configuration of the disclosure described in the detailed description or claims of the present disclosure.

BEST MODE FOR CARRYING OUT THE INVENTION

Figure 1:
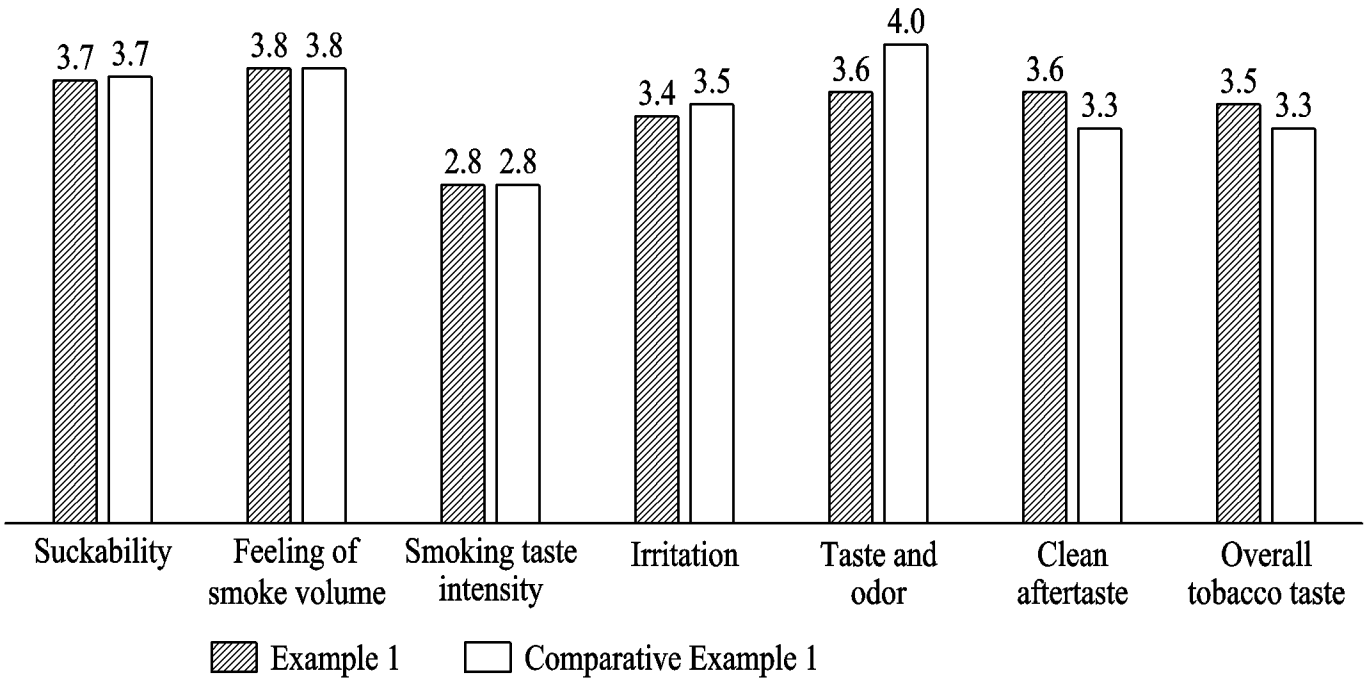
FIG. 1 is a view showing sensory evaluation results for tobacco taste of Example 1 and Comparative Example 1 of ultra-low nicotine smoking articles according to one embodiment of the present disclosure.

Hereinafter, embodiments will be described in detail with reference to the accompanying drawings. However, since various changes may be made to the embodiments, the scope of rights of the patent application is not restricted or limited by these embodiments. It should be understood that all modifications, equivalents, and substitutes for the embodiments are included in the scope of the rights.

The terms used in the embodiments are used for the purpose of description only, and should not be construed as an intention to limit the present disclosure. The singular expression includes the plural expression unless the context clearly dictates otherwise. In the present specification, it should be understood that a term such as "include", "have", or the like is intended to designate that a feature, a number, a step, an operation, a component, a part, or a combination thereof described in the specification exists, but it does not preclude the possibility of existence or addition of one or more other features, numbers, steps, operations, components, parts, or combinations thereof.

Unless defined otherwise, all terms used herein, including technical or scientific terms, have the same meaning as those commonly understood by those skilled in the art to which the embodiments belong. Terms such as those defined in a commonly used dictionary should be interpreted as having a meaning consistent with the meaning in the context of the related art, and should not be interpreted in an ideal or excessively formal meaning unless explicitly defined in the present application.

Further, in the description with reference to the accompanying drawings, the same components are assigned the same reference numerals regardless of the reference numerals, and overlapping descriptions thereof will be omitted. In the description of the embodiments, if it is determined that a detailed description of a related known technology may unnecessarily obscure the gist of the embodiments, the detailed description thereof will be omitted.

Further, in describing constituent elements of the embodiments, terms such as first, second, A, B, (a), (b), etc. may be used. Such terms are only for distinguishing the constituent elements from other constituent elements, and essences, orders, or sequences of the corresponding constituent elements are not limited by the terms.

Constituent elements included in any one embodiment and constituent elements including a common function will be described using the same names in other embodiments. Unless otherwise stated, descriptions described in any one embodiment may also be applied to other embodiments, and detailed descriptions will be omitted in the overlapping range.

Throughout the specification, when a certain part is said to "include" a certain component, it means that it may further include other components rather than excluding other components.

Throughout the specification, a 'smoking article' may refer to an article capable of generating an aerosol, such as tobacco (cigarettes), cigars, etc. The smoking article may include an aerosol-generating material or an aerosol-forming substrate. In addition, the smoking article may include a solid material based on tobacco raw materials such as reconstituted tobacco sheet tobacco, cut tobacco, and reconstituted tobacco. The smoking article may include volatile compounds.

Further, throughout the specification, 'upstream' or 'upstream direction' refers to a direction away from the mouth of a user smoking a smoking article, and 'downstream' or 'downstream direction' refers to a direction approaching from the mouth of the user smoking the smoking article.

Throughout the specification, an 'ultra-low nicotine smoking article' may mean a smoking article in which the tobacco medium has a nicotine content of 0.01% to 0.05%.

The medium part of the smoking article may be manufactured in the following way. The leaf tobacco that has been subjected to foreign substance screening is blended, cut by a cutter, and then passed through a dryer. Then, apart from blending, it may be flavoring-treated with a flavoring liquid substance in a flavoring facility to compensate for the insufficient flavor and aroma taste of leaf tobacco or to mask undesirable aroma and taste. The main raw materials of the tobacco medium used in this process are flue-cured tobacco, Burley tobacco (air-cured tobacco), and Oriental tobacco (sun-cured tobacco), and sub-materials are reconstituted tobacco sheet, dry ice expanded tobacco (DIET), and expanded stems (STS).

According to one embodiment of the present disclosure, an ultra-low nicotine smoking article may be provided. The smoking article may include a medium part and a filter part, and the medium part may contain a tobacco medium including flue-cured tobacco, dry ice expanded tobacco (DIET), and expanded stems (STS). The tobacco medium may include 50% by weight (wt %) to 60 wt % of flue-cured tobacco, 20 wt % to 30 wt % of dry ice expanded tobacco, and 10 wt % to 30 wt % of expanded stems based on the total weight. At this time, the tobacco medium may have a nicotine content of 0.01% to 0.05%.

In another embodiment of the present disclosure, there may be provided an ultra-low nicotine smoking article including a medium part and a filter part, wherein the medium part contains a tobacco medium including flue-cured tobacco, dry ice expanded tobacco, and expanded stems, and the tobacco medium has a nicotine content of 0.01% to 0.05%. In this case, tar and nicotine among smoke components in the mainstream smoke of the smoking article may have a content ratio of 150:1 to 330:1.

Flue-cured tobacco is one of the main raw materials for tobacco, and is characterized by having a high sugar content. When blending, it may play a role of leading the unique taste. However, when the content of flue-cured tobacco increases, there are problems in that the combustibility (or thermal conductivity) of the smoking article decreases, and the suckability decreases.

Dry ice expanded tobacco is a leaf tobacco obtained by instantaneously performing expansion with high-temperature steam after cooling flue-cured leaf tobacco using carbon dioxide. It may play a role of imparting combustibility (or thermal conductivity) during blending. When the content of dry ice expanded tobacco is increased too much, there is a problem in that combustibility (or thermal conductivity) is excessively increased.

Expanded stems may play a role of adjusting the amount of nicotine migration during blending and imparting combustibility (or thermal conductivity). The expanded stems may be used as a filler for smoking articles, and since the stems are a by-product of leaf tobacco, there is also an effect of reducing costs. However, when the content of the expanded stems increases, there may be a problem in that the taste of tobacco is reduced due to the expression of negative smoking taste such as spicy taste, irritating taste, etc.

Therefore, there may be provided a smoking article that may control the nicotine content of the tobacco material and has excellent tobacco taste and appropriate combustibility (or thermal conductivity) by varying the contents of flue-cured tobacco, dry ice expanded tobacco, and expanded stems.

In the smoking article according to the present disclosure, when the content of flue-cured tobacco is less than 50 wt %, there is a problem in that the original taste of tobacco is insufficient, and when the content of flue-cured tobacco exceeds 60 wt %, the nicotine content of the tobacco medium may exceed 0.05%.

When the content of dry ice expanded tobacco is less than 20 wt %, the combustion rate of tobacco may be lowered, and when the content of dry ice expanded tobacco is more than 30 wt %, there may be problems in that the original taste of tobacco is insufficient, and suckability is weakened.

Meanwhile, the content of the expanded stems may be 10 wt % to 30 wt %, desirably 15 wt % to 25 wt %, and more desirably 17 wt % to 23 wt %. When the content of the expanded stems is less than 10 wt %, the tobacco medium may have a nicotine content exceeding 0.05%, and when it exceeds 30 wt %, negative tastes such as spicy taste, irritating taste, etc. may be expressed.

Meanwhile, in the case of the flue-cured tobacco, dry ice expanded tobacco, and expanded stems, they may be separated from at least one selected from the group consisting of thick leaves and thin leaves of flue-cured tobacco. However, in the aspect of the above effectiveness, it is preferable that they are blended by being separated from the thick leaves and thin leaves of flue-cured tobacco.

In a smoking article according to one embodiment of the present disclosure, the tobacco medium may have a nicotine content of 0.01% to 0.05%, and desirably 0.03% to 0.05%. The tobacco medium used in an existing commercially available smoking article usually has a nicotine content of about 5% or less. In the present disclosure, the nicotine content of the smoking article may be lowered to a level that does not cause addiction by using a tobacco medium in which the nicotine content is lowered by 95% or more compared to the tobacco medium used in the commercially available smoking article.

In one embodiment of the present disclosure, the tobacco medium may be obtained from a plant having one or more morphological characteristics of the following (1) to (16).

(1) The plant shape is elliptical;
(2) The plant height is 123 to 124 cm;
(3) The main stem color of the plant is green;
(4) The number of plant leaves is 24 to 25;
(5) The degree of plant auxiliary bud development is 1.5;
(6) The presence or absence of petiole is disease-free leaves;
(7) The leaf angle is medium;
(8) The leaf length is 60 to 65 cm;
(9) The leaf width is 30 to 35 cm;
(10) The leaf shape is broad elliptical;
(11) The leaf cross-sectional shape is convex;
(12) The leaf longitudinal-section is curved moderately posteriorly;
(13) The irregularity degree of the leaf surface is moderate;
(14) The wavy shape of the leaf margin is weak;
(15) The development degree of auricle is strong; and
(16) The leaf color is pale green.

In one embodiment of the present disclosure, the tobacco medium may be obtained from a plant having one or more morphological characteristics of the following (17) to (32).

(17) The ground-leaved tree is medium;
(18) The flowering season is early;
(19) The flowering days are 60 to 65 days;
(20) The flower length is 55 to 60 mm;
(21) The diameter of the flower tube is 5 to 6 mm;
(22) The size of the flower corolla is 28 to 32 mm;
(23) The degree of protrusion at the tip of the flower corolla is strong;
(24) The color of the corolla is pink;
(25) The development of floral stamens is normal;
(26) The length of the pistil compared to the stamen is short;
(27) The blossom shape is inverted conical;
(28) The blossoms are located above the upper leaf;
(29) The blossom density degree is medium;
(30) The capsule shape is ovoid;
(31) There is no male sterility; and
(32) There is no resistance to tobacco mosaic virus (TMV) and potato virus Y (PVY).

In one embodiment of the present disclosure, the tobacco medium may be obtained from a plant having one or more morphological characteristics of the above (1) to (32).

In one embodiment of the present disclosure, the tobacco medium may be obtained from tobacco (scientific name: *Nicotiana tabacum* L.) with the variety name KF 128 variety-registered in Korea Seed & Variety Service. KF128 may have any one or more of the aforementioned characteristics.

Meanwhile, KF128 may have distinct characteristics as shown in the following (33) to (40), compared to K326, which is currently a major flue-cured tobacco cultivation species in the United States.

(33) KF128 has long leaves compared to K326;
(34) KF128 has wide leaves compared to K326;
(35) KF128 has a broadly elliptical leaf shape, but K326 has a narrow elliptical leaf shape;
(36) KF128 has a medium leaf apex shape, but K326 has a severely sharp leaf apex shape;
(37) KF 128 has a medium irregularity degree of the leaf surface, but K326 has a strong irregularity degree of the leaf surface;
(38) KF128 has a weak wavy shape of the leaf edge, but K326 has a moderate wavy shape of the leaf edge;
(39) KF128 has a short flower length compared to K326;
(40) KF 128 has a small corolla size compared to K326.

In a smoking article according to one embodiment of the present disclosure, the tobacco medium may have a total nitrogen content of 0.05% to 1%. A nitrogen-containing substance among smoke components, particularly $NO_3$, is a precursor of substances that cause irritation during smoking and is also a component that causes odor. The use of a tobacco medium with a low total nitrogen content may reduce irritation during smoking. In addition, it may be possible to reduce the smell of tobacco generated during/after smoking by reducing odor-causing components themselves. In addition, there is an advantage in that it may be possible to reduce the smell of tobacco clung to the mouth, clothes, hands, etc. after smoking by reducing nitrogen compounds, which are odor components peculiar to tobacco, contained in mainstream smoke and sidestream smoke.

A smoking article according to one embodiment of the present disclosure may additionally include an excipient such as a binder or other additive, but is not limited thereto.

The binder is a material capable of increasing the hardness by allowing the pulverized tobacco medium, etc. to be bound well, and any material known in the concerned technical field may be used without limitation. For example, it may include one or more selected from the group consisting of: alginate; cellulose such as methyl cellulose, ethyl cellulose, ethyl hydroxyethyl cellulose, and carboxymethyl cellulose; dextran; gum; gum derivatives such as hydroxyethyl guar gum, hydroxypropyl guar gum, hydroxyethyl locust bean gum, and hydroxypropyl locust bean gum; pectins such as fruit pectin, citrus pectin, and tobacco pectin; starch such as modified or derivatized starch; pullulan; and konjac powder.

The other additive may additionally include one or more selected from the group consisting of a humectant, a plasticizer, tobacco and non-tobacco fibers, aqueous and non-aqueous solvents, and combinations thereof, but are not limited thereto.

The humectant is a material that helps to maintain a desirable level of moisture in the medium part, and may include glycerin, propylene glycol, or the like, but is not limited thereto.

The plasticizer is a preparation that increases moldability by softening a material, and may include, for example, one or more selected from the group consisting of triacetin, dibutyl phthalate, dibutyl sebacate, diethyl phthalate, dimethyl phthalate, acetyl tributyl citrate, acetyl triethyl citrate, diacetylated monoglyceride, dibutyl sebacate, mineral oil, benzyl benzoate, chlorobutanol, glycerin monostearate, lanolin alcohol, and cellulose acetate phthalate compatible plasticizers, but is not limited thereto.

Examples of the tobacco fiber may include a tobacco cellulose fiber, and when this is contained, the tensile strength of the tobacco medium may be increased. Meanwhile, examples of the non-tobacco fiber are known in the concerned technical field and may include a non-tobacco cellulose fiber. Examples of an appropriate non-tobacco fiber may include one or more selected from the group consisting of a hardwood fiber, a softwood fiber, a jute fiber, and a flax fiber, but are not limited thereto.

In a smoking article according to one embodiment of the present disclosure, the medium part may have a weight of, for example, 500 mg/cig to 700 mg/cig.

In one embodiment of the present disclosure, the filter part may be located at the downstream end of the smoking article and may be a mono filter or a composite filter. The composite filter may be, for example, a double filter or a triple filter.

The filter part may contain at least one fiber selected from the group consisting of cellulose acetate, lyocell, polypropylene, polyester, and polylactic acid, but is not limited to the examples described.

Meanwhile, the filter part may further contain activated carbon and a plasticizer. Activated carbon may reduce smoke components present in mainstream smoke, and as types of activated carbon, not only normal activated carbon but also super activated carbon may be applicable, and composite activated carbon may also be used. The plasticizer may impart hardness to the smoking article through inter-fiber bonding, and there may be triacetin as a type of the plasticizer.

In addition, the filter part may separately contain a capsule containing a flavoring liquid in order to improve the taste of tobacco, and a flavoring-treated filter may be used. The capsule containing a flavoring liquid exhibits crushability that may be broken when pressure is applied. For example, when crushed by hand, the flavoring liquid existing inside the capsule may wet the filter part. Meanwhile, the flavoring-treated filter may be manufactured, for example, using a transfer jet nozzle system (TJNS) method that sprays a flavoring liquid to tow during the filter manufacturing process. If a capsule containing the flavoring liquid and a TJNS filter are used at the same time, it may be preferable for a filter containing activated carbon to be located upstream compared to the capsule and the TJNS filter in that the components of the flavoring liquid are adsorbed thereon while passing through activated carbon and there is a concern that its function may be reduced.

In one embodiment of the present disclosure, the filter part may have a pressure drop of 60 to 100 mmWG. For example, the pressure drop may be 70 mmWG to 90 mmWG, or 77 mgWG to 85 mmWG.

A smoking article according to one embodiment of the present disclosure may further include a filter wrapping paper surrounding the filter part, a tip paper surrounding the filter wrapping paper, and a cigarette paper.

The filter wrapping paper may surround the filter part to form a filter segment. For example, the filter wrapping paper may have an oil-resistant function in order to prevent a phenomenon in which the contents penetrate into the tip paper due to crushing of the capsules contained in the filter part.

The tip paper is a paper that connects the cigarette and the filter, and may have perforations formed therein. The perforations serve to dilute the smoke components of the smoking article by increasing the dilution rate of tobacco.

The cigarette paper is a thin and light paper for rolling and smoking cigarettes, and mainly flax and wood pulp are used as raw materials. Cigarette paper additives may include a filler and a combustion improver. The filler may serve to improve whiteness and opacity, adjust porosity, and reduce paper odor upon combustion. Meanwhile, the combustion improver may serve to promote or inhibit combustion.

In the smoking article according to the present disclosure, the smoking article may have an unencapsulated pressure drop (UPD) and an encapsulated pressure drop (EPD) of 80 mm WG to 100 mmWG and 120 mmWG to 155 mmWG, respectively. Here, UPD means the pressure drop when smoking without blocking the perforations of the filter, and EPD means the pressure drop when smoking after blocking the perforations of the filter.

For the smoking article according to the present disclosure, the UPD/EPD value may be 0.5 to 0.9, desirably 0.51 to 0.8. When the UPD/EPD value is lowered, suckability is improved, and feeling of smoke volume may be increased.

The circumference of the smoking article may be 15 mm to 30 mm, desirably 16 mm to 27 mm. For example, the circumference of the smoking article may be 24.2 mm for regular cigarettes, 21.7 mm for slim cigarettes, and 16.7 mm for ultra slim cigarettes.

Meanwhile, the smoking article may have a hardness of 55% to 98%. For example, the smoking article may have a hardness of 60% to 96%, or 70% to 80%.

However, it is not limited to the described range.

In one embodiment of the present disclosure, the smoking article may have an air dilution rate of 10% to 60%. For example, the air dilution rate may be 20% to 60%, or 30% to 40%.

In one embodiment of the present disclosure, tar among smoke components in mainstream smoke of the smoking article may be contained in an amount of 4 mg/cig to 8 mg/cig.

In one embodiment of the present disclosure, nicotine among smoke components in mainstream smoke of the smoking article may be contained in an amount of 0.02 mg/cig to 0.05 mg/cig. For example, nicotine may be contained in an amount of 0.02 mg/cig to 0.04 mg/cig.

In one embodiment of the present disclosure, carbon monoxide among smoke components in mainstream smoke of the smoking article may be contained in an amount of 3 mg/cig to 18 mg/cig. For example, carbon monoxide may be contained in an amount of 5 mg/cig to 11 mg/cig.

In one embodiment of the present disclosure, tar and nicotine among smoke components in mainstream smoke of the smoking article may have a content ratio of 80:1 to 400:1. For example, tar and nicotine among the smoke components in the mainstream smoke of the smoking article may have a content ratio of 100:1 to 400:1, 111:1 to 334:1, 90:1 to 355:1, 112:1 to 355:1, 125:1 to 296:1, 175:1 to 210:1, or 180:1 to 200:1.

A smoking article according to one embodiment of the present disclosure may be a combustion type or a non-combustion type. The combustion type smoking article may refer to a traditional cigarette. The non-combustion type smoking article includes an electrical smoking article that is indirectly heated by electric energy rather than direct combustion.

In the case of an electrical smoking article, it may include a non-combustion type smoking article and an aerosol-generating device into which the non-combustion type smoking article may be inserted. The electrical smoking article may be an article allowing smoking to be performed in such a manner that it heats an inserted smoking article by using electric energy to generate an aerosol, and releases the aerosol after such an aerosol being inhaled by the user.

A non-combustion type smoking article according to one embodiment of the present disclosure may have various structures.

For example, a smoking article according to one embodiment of the present disclosure may further include a support structure and a cooling structure between the medium part and the filter part.

The support structure may be located downstream of the medium part and may be a tube-shaped structure including a hollow therein. The support structure serves to support the medium part so that it is not pushed when the medium part is inserted into the aerosol-generating device, and may serve to move the atomization. The support structure may be manufactured using, for example, cellulose acetate, and the hardness of the support structure may be adjusted by varying the amount of the plasticizer added during manufacturing of the support structure. Alternatively, the support structure may be manufactured by inserting a structure such as a film, a tube, or the like made of the homogenous or heterogeneous material into the hollow.

The cooling structure may be located downstream of the support structure. When a smoker inhales an aerosol generated by heating a medium part, heat may be generated especially in the first puff, which may cause a smoker to feel displeasure. The cooling structure may serve as a cooling member that cools the aerosol generated by heating the medium part. Accordingly, the smoker may inhale the aerosol cooled to an appropriate temperature.

As another example, a smoking article according to one embodiment of the present disclosure may further include a pre-filter segment and a support structure as well as a medium part and a filter part.

The pre-filter segment may be located upstream of the medium part. The pre-filter segment may serve to recognize that it is a dedicated smoking article used in the aerosol-generating device. The pre-filter segment may be made of, for example, cellulose acetate. A hollow may be formed in the center of the pre-filter segment, or only microchannels may be formed so that the tobacco medium in the medium part is prevented from being eliminated to the outside but only enough to form an air flow path.

However, the examples described above are only examples of a non-combustion type smoking article in which the present disclosure may be used, but the present disclosure is not limited to the examples described above.

The aerosol-generating device may include some or all of a battery, a controller, a vaporizer, and a heater. The arrangement relation of the components may be changed depending on the design of the aerosol-generating device.

The battery may supply the power necessary for the aerosol-generating device to operate. For example, the battery may supply power so that the heater may be heated, and may supply power so that the controller operates. In addition, the battery may supply power necessary for the display, sensor, motor, etc. installed in the aerosol-generating device to operate.

The controller may control the operation of the aerosol-generating device as a whole. For example, the controller may control the operation of a battery, a heater, and other components that may be included in the aerosol-generating device. In addition, the controller may determine whether the aerosol-generating device is in an operable state or not by checking the state of each of the components of the aerosol-generating device.

The vaporizer may generate an aerosol by heating a liquid composition, and the vaporizer may include, for example, a liquid storage part, a liquid delivery means, and a heating element, but is not limited thereto. When the smoking article is inserted into the aerosol-generating device, the aerosol-generating device may generate an aerosol from the smoking article and/or vaporizer by operating a heater and/or vaporizer. The generated aerosol passes through the smoking article and is delivered to the smoker. The vaporizer may be referred to as a cartomizer or an atomizer, but is not limited thereto.

The heater may be heated by power supplied from a battery. For example, when a smoking article is inserted into an aerosol-generating device, a heater may be inserted into some regions inside the smoking article to heat the inside of the smoking article, heat the outside of the smoking article, or heat both the inside and outside of the smoking article, thereby aerosolizing volatile substances within the smoking article. The shape of the heater may have various shapes such as a tubular shape, a plate shape, a needle shape, or a rod shape, and the number of heaters may be single or plural. Meanwhile, the heater may be an electric resistance heater or an induction heating-type heater.

The aerosol-generating device may further include general-purpose components in addition to the components described above.

Hereinafter, the present disclosure will be described in more detail with reference to examples, but the present disclosure is not limited to the following examples.

1. Manufacturing of Smoking Articles

The ultra-low nicotine smoking articles of Examples 1 and 2 and Comparative Examples 1 to 3 were manufactured. Design details of examples and comparative examples are shown in Table 1 below. Components and contents of the medium part are as follows.

Example 1

The medium part contained a tobacco medium including flue-cured tobacco, dry ice expanded tobacco, and expanded stems, and the tobacco medium was blended from 55 wt % of flue-cured tobacco, 25 wt % of dry ice expanded tobacco, and 20 wt % of expanded stems based on the total weight.

Example 2

The medium part contained a tobacco medium including flue-cured tobacco, dry ice expanded tobacco, and expanded stems, and the tobacco medium was blended from 55.3 wt % of flue-cured tobacco, 22.3 wt % of dry ice expanded tobacco, and 22.4 wt % of expanded stems based on the total weight.

Comparative Example 1

The medium part contained a tobacco medium including flue-cured tobacco and expanded stems, and the tobacco medium was blended from 78.9 wt % of flue-cured tobacco and 19.4 wt % of expanded stems based on the total weight.

Comparative Example 2

The medium part contained a tobacco medium including flue-cured tobacco, dry ice expanded tobacco, and expanded stems, and the tobacco medium was blended from 45.0 wt % of flue-cured tobacco, 20.0 wt % of dry ice expanded tobacco, and 35.0 wt % of expanded stems based on the total weight.

Comparative Example 3

The medium part contained a tobacco medium including flue-cured tobacco, dry ice expanded tobacco, and expanded stems, and the tobacco medium was blended from 63.2 wt % of flue-cured tobacco, 24.0 wt % of dry ice expanded tobacco, and 12.7 wt % of expanded stems based on the total weight.

TABLE 1

| Test items | | Example 1 | Example 2 | Comparative Example 1 | Comparative Example 2 | Comparative Example 3 |
|---|---|---|---|---|---|---|
| Cigarette system | Total length (mm) | 84 | 84 | 83 | 84 | 84 |
| | Filter length (mm) | 24 | 24 | 25 | 24 | 24 |
| | Medium part length (mm) | 60 | 60 | 58 | 60 | 60 |
| | Tip paper length (mm) | 29 | 29 | 30 | 29 | 29 |
| | Cigarette circumference (mm) | 24.6 | 24.6 | 24.8 | 24.6 | 24.6 |
| Medium part | Weight (mg/cig) | 575 | 673 | 652 | 681 | 646 |
| Filter part | Type | Acemono + acemono (activated carbon) | Acemono + acemono (activated carbon) | Acemono + paper filter | Acemono + acemono (activated carbon) | Acemono + acemono (activated carbon) |
| | Pressure drop (mmWG) | 85 | 77 | 90 | 76 | 75 |
| Smoking article UPD (mmWG) | | 97 | 86 | 126 | 85 | 85 |
| Smoking article EPD (mmWG) | | 125 | 153 | 143 | 147 | 147 |

Here, acemono means a filter made of cellulose acetate tow, and in the case of Examples 1 and 2 and Comparative Examples 2 and 3, it is a shape in which activated carbon is added to the acemono filter part. In the case of Comparative Example 1, it is a filter with a double composite structure of acemono and a paper filter, and does not contain activated carbon.

2. Experimental Example 1: Content Analysis of Nicotine, $NO_3$, and Ammonia in Tobacco Mediums The contents of nicotine, $NO_3$, and ammonia in the tobacco mediums of Examples 1 and 2 and Comparative Examples 1 to 3 were investigated in the following manner. The analysis was proceeded by the AUTO ANALYSIS method, a 0.5 g medium powder was immersed in an acetic acid solvent with a concentration of 5%, the extract thereof was filtered and subjected to color development, and then content components were analyzed through the absorbance wavelength analysis in the visible ray region using CONTINUANCE FLOW ANALYSIS (CFA) equipment. The results are shown in Table 2 below.

TABLE 2

| Content (%) | Example 1 | Example 2 | Comparative Example 1 | Comparative Example 2 | Comparative Example 3 |
|---|---|---|---|---|---|
| Nicotine | 0.05 or less | 0.05 | 0.08 | 0.05 | 0.06 |
| $NO_3$ | 0.34 | 0.34 | 1.99 | 0.48 | 0.23 |
| Ammonia | 0.05 | 0.05 | 0.45 | 0.05 | 0.05 |

3. Experimental Example 2: Analysis of Components of Mainstream Smoke of Smoking Articles The results of analyzing components of the mainstream smokes of Examples 1 and 2 and Comparative Examples 1 to 3 are shown in Table 3 below.

TABLE 3

| Classification | TPM (mg/cig) | Tar (mg/cig) | Nicotine (mg/cig) | Carbon monoxide (mg/cig) | Number of puffs |
|---|---|---|---|---|---|
| Example 1 | 7.9 | 7.1 | 0.036 | 10.6 | 6.5 |
| Example 2 | 5.0 | 4.5 | 0.024 | 5.0 | 8.4 |
| Comparative Example 1 | 8.4 | 7.7 | 0.046 | 17.1 | 5.8 |
| Comparative Example 2 | 4.5 | 4.0 | 0.025 | 5.1 | 8.4 |
| Comparative Example 3 | 4.6 | 4.6 | 0.027 | 5.0 | 8.2 |

Comparing the results of Example 1 in which the number of puffs was about 6 with Comparative Example 1, a nicotine content in the mainstream smoke was reduced by 0.01 mg/cig in Example 1 compared to Comparative Example 1. The ratio of a tar content to a nicotine content was 197:1 in Example 1 and 167:1 in Comparative Example 1, and it may be seen that a reduction rate of a nicotine content is greater than a reduction rate of a tar content in the mainstream smoke in Example 1.

Comparing the results of Example 2 in which the number of puffs was 8 or more with Comparative Examples 2 and 3, the nicotine content in the mainstream smoke was reduced by 0.001 to 0.003 mg/cig in Example 2 compared to Comparative Examples 2 and 3. The ratio of a tar content to a nicotine content was 188:1 in Example 2, 160:1 in Comparative Example 2, and 170:1 in Comparative Example 3, and it may be seen that a reduction rate of a nicotine content is greater than a reduction rate of a tar content in the mainstream smoke in Example 2.

Meanwhile, the carbon monoxide contents in the mainstream smokes of Examples 1 and 2 showed reduced results compared to Comparative Examples 1 to 3.

4. Experimental Example 3: Tobacco Taste Evaluation

Sensory evaluation was conducted to compare the tobacco tastes of Examples 1 and 2 and Comparative Examples 1 and 2. The sensory evaluation was evaluated numerically by confirming the cigarette taste that smoker felt during smoking, and was conducted on 17 evaluation panel members, and the evaluation was performed based on a total score of 7 points. Sensory evaluation results are shown in FIGS. 1 and 2.

FIG. 1 is a result of proceeding sensory evaluation of the tobacco tastes of Example 1 and Comparative Example 1 under the same conditions. Compared to Comparative Example 1, Example 1 showed results in which the taste and odor were reduced, the aftertaste was cleaner, and the overall tobacco taste was improved.

Figure 2:
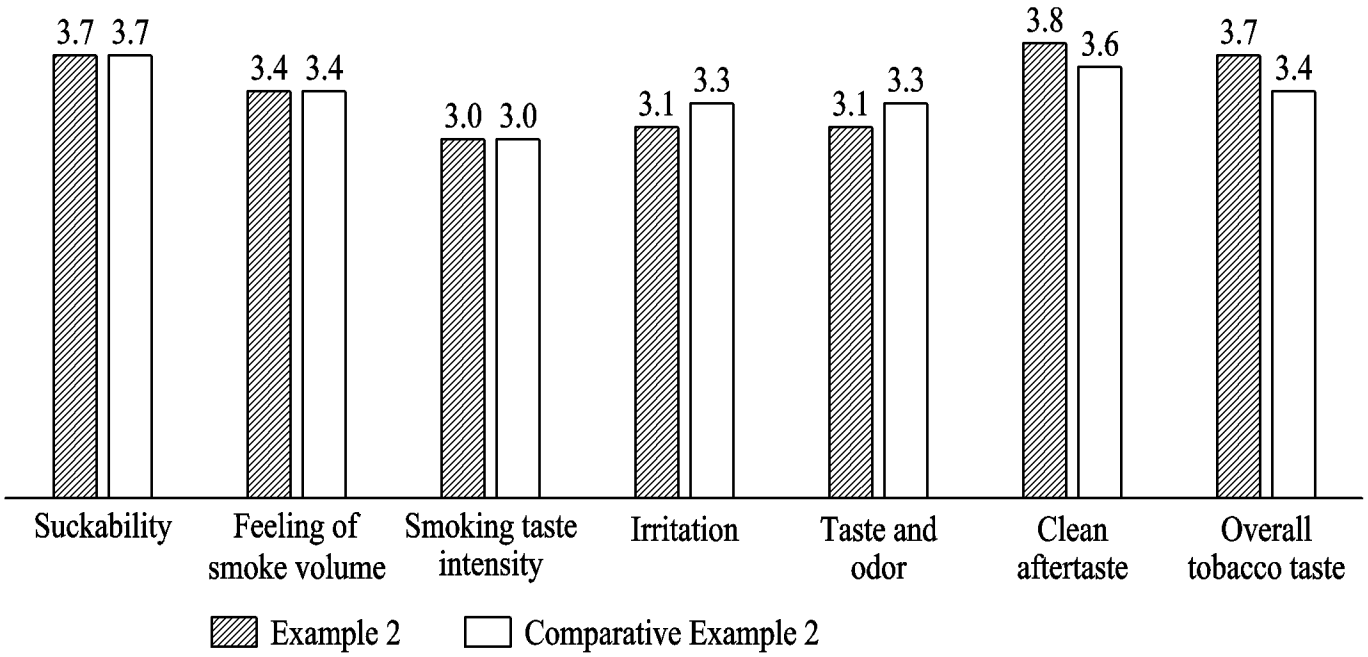
FIG. 2 is a view showing sensory evaluation results for tobacco taste of Example 2 and Comparative Example 2 of ultra-low nicotine smoking articles according to one embodiment of the present disclosure.

FIG. 2 is a result of proceeding sensory evaluation of the tobacco tastes of Example 2 and Comparative Example 2 under the same conditions. Compared to Comparative Example 2, Example 2 showed results in which the irritation and taste and odor were reduced, the aftertaste was cleaner, and the overall tobacco taste was improved.

5. Experimental Example 4: Combustibility Measurement

Combustibility in the present disclosure means the time required when the smoking article is naturally burned by 30 mm. The combustibility of Example 1 was measured using an automatic time-distance analysis method. Specifically, the time required for naturally burning 30 mm of Example 1 was measured 10 times, and this was repeated once more to obtain the resultant value. At this time, the pretreatment was conducted under conditions of a temperature of 22±1° C. and moisture of 60±2%, and the experiment was conducted under conditions of a temperature of 22±2° C. and moisture of 60±5%.

As a result, the combustibility of Example 1 was measured to be 5 minutes and 38 seconds.

6. Experimental Example 5: Measurement of Air Dilution Rates

Air dilution rates of Examples 1 and 2 and Comparative Example 1 were measured. As a result, the air dilution rates of Examples 1 and 2 were 32% and 56.1%, respectively, and it was confirmed to have improved air dilution rates compared to the air dilution rate of 13% of Comparative Example 1.

From the above experimental embodiments, when the disclosure described in the claims of the present disclosure is used, it will be possible to provide an ultra-low nicotine smoking article that maintains tobacco taste and combustibility (or thermal conductivity) while maintaining the nicotine content of the tobacco medium as low as 0.05% or less.

Although the above-mentioned embodiments have been described by limited drawings, those skilled in the art may apply various technical modifications and alterations based on the above-mentioned description. For example, appropriate results may be achieved although described techniques are carried out in a different order from a described method, and/or described elements of a system, structure, apparatus, circuit, etc. are combined or mixed in a different form from the described method, or replaced or substituted with other elements or equivalents.

Therefore, other implementations, other embodiments, and equivalents to patent claims belong to the scope of the patent claims to be described later.

The invention claimed is:

1. An ultra-low nicotine smoking article consisting of a medium part and a filter part, wherein the medium part is a tobacco medium consisting of 50% by weight (wt %) to 60 wt % of flue-cured tobacco, 20 wt % to 30 wt % of dry ice expanded tobacco, and 10 wt % to 30 wt % of expanded stems based on the total weight, wherein the tobacco medium is obtained from *Nicotiana tabacum* L., wherein the tobacco medium is a blend of leaf tobacco having a total nitrogen content of 0.05% to 1%, and wherein the tobacco medium has a nicotine content of 0.01% to 0.05%.

2. The ultra-low nicotine smoking article of claim 1, wherein the flue-cured tobacco, dry ice expanded tobacco, and expanded stems are separated from at least one selected from the group consisting of thick leaves and thin leaves of flue-cured tobacco.

3. The ultra-low nicotine smoking article of claim 1, wherein the smoking article has an air dilution rate of 10% to 60%.

4. The ultra-low nicotine smoking article of claim 1, wherein tar among smoke components in mainstream smoke of the smoking article is contained in an amount of 4 mg/cig to 8 mg/cig.

5. The ultra-low nicotine smoking article of claim 1, wherein nicotine among smoke components in mainstream smoke of the smoking article is contained in an amount of 0.02 mg/cig to 0.05 mg/cig.

6. The ultra-low nicotine smoking article of claim 1, wherein carbon monoxide among smoke components in mainstream smoke of the smoking article is contained in an amount of 3 mg/cig to 18 mg/cig.

7. The ultra-low nicotine smoking article of claim 1, wherein the smoking article has an UPD/EPD value of 0.5 to 0.9.

8. The ultra-low nicotine smoking article of claim 1, wherein the medium part has a weight of 500 mg/cig to 700 mg/cig.

9. The ultra-low nicotine smoking article of claim 1, wherein the filter part may have a pressure drop of 60 mmWG to 100 mmWG.

10. An ultra-low nicotine smoking article consisting of a medium part and a filter part, wherein the medium part is a tobacco medium consisting of 50% by weight (wt %) to 60 wt % of flue-cured tobacco, 20 wt % to 30 wt % of dry ice expanded tobacco, and 10 wt % to 30 wt % of expanded stems based on the total weight, wherein the tobacco medium is obtained from *Nicotiana tabacum* L., wherein the tobacco medium is a blend of leaf tobacco having a total nitrogen content of 0.05% to 1%, wherein the tobacco medium has a nicotine content of 0.01% to 0.05%, and wherein tar and nicotine among smoke components in mainstream smoke of the smoking article have a content ratio of 80:1 to 400:1.

11. The ultra-low nicotine smoking article of claim 10, wherein nicotine among the smoke components in the mainstream smoke of the smoking article is contained in an amount of 0.02 mg/cig to 0.05 mg/cig.

12. The ultra-low nicotine smoking article of claim 10, wherein the smoking article has an UPD/EPD value of 0.5 to 0.9.

13. The ultra-low nicotine smoking article of claim 10, wherein the medium part has a weight of 500 mg/cig to 700 mg/cig.

14. The ultra-low nicotine smoking article of claim 10, wherein the filter part may have a pressure drop of 60 mmWG to 100 mmWG.

* * * * *